United States Patent [19]

Smith et al.

[11] 4,387,372

[45] Jun. 7, 1983

[54] POINT GAP ASSEMBLY FOR A TOROIDAL COUPLED TELEMETRY SYSTEM

[75] Inventors: Harrison C. Smith, Richardson; William J. McDonald, Houston, both of Tex.

[73] Assignee: Tele-Drill, Inc., Richardson, Tex.

[21] Appl. No.: 245,686

[22] Filed: Mar. 19, 1981

[51] Int. Cl.[3] ..... G01V 1/40

[52] U.S. Cl. ..... 340/854; 367/81; 166/66; 175/40; 455/40

[58] Field of Search ..... 340/853, 854; 175/40, 175/50; 166/66; 455/40, 50; 367/81, 82

[56] References Cited

U.S. PATENT DOCUMENTS

| | | | |
|---|---|---|---|
| 2,354,887 | 8/1944 | Silverman et al. | 340/856 |
| 2,400,170 | 5/1946 | Silverman | 340/854 |
| 2,414,719 | 1/1947 | Cloud | 340/854 |
| 2,940,039 | 6/1960 | Yost et al. | 340/854 |
| 2,992,325 | 7/1961 | Lehan | 455/21 |
| 3,090,031 | 5/1963 | Lord | 340/854 |
| 3,315,224 | 4/1967 | Ferguson | 340/853 |
| 3,333,239 | 7/1967 | Silverman | 367/81 |
| 3,831,138 | 8/1974 | Rammner | 367/81 |

*Primary Examiner*—Nelson Moskowitz

*Attorney, Agent, or Firm*—Bradford E. Kile; John J. Byrne

[57] ABSTRACT

An insulated point gap assembly for a toroidal coupled telemetry system wherein a drill collar (38), operable to be connected to a lower portion of a drill string (32), carries a toroidal core having primary windings (88) and secondary windings (130). An aperture (154) is laterally fashioned through the drill collar. A conductor (150) is connected to one end of the secondary and extends through the aperture and the other end of the secondary is connected to the drill collar. The conductor is surrounded by an electrical insulation member (152). In a preferred embodiment, an axially extending sleeve of insulating material (156) is applied about the drill collar at the location of the conductor (150) to further isolate the conductor 15 from the drill collar.

4 Claims, 5 Drawing Figures

POINT GAP ASSEMBLY FOR A TOROIDAL COUPLED TELEMETRY SYSTEM

BACKGROUND OF THE INVENTION

This application relates to an apparatus for facilitating measuring borehole data and for transmitting the data to the surface for inspection and analysis. Although the subject invention may find substantial utility at any stage in the life of a borehole, a primary application is in providing real time transmission of large quantities of data simultaneously while drilling. This concept is frequently referred to in the art as downhole measuring while drilling or simply measurements-while-drilling (MWD).

The incentives for receiving reliable downhole measurements during drilling operations are substantial. Downhole measurements while drilling will allow safer, more efficient, and more economic drilling of both exploration and production wells.

Continuous monitoring of downhole conditions will allow immediate response to potential well control problems. This will allow better mud programs and more accurate selection of casing seats, possibly eliminating the need for an intermediate casing string, or a liner. It also will eliminate costly drilling interruptions while circulating to look for hydrocarbon shows at drilling breaks, or while logs are run to try to predict abnormal pressure zones.

Drilling will be faster and cheaper as a result of real time measurement of parameters such as bit weight, torque, wear and bearing condition. The faster penetration rate, better trip planning, reduced equipment failures, delays for directional surveys, and elimination of a need to interrupt drilling for abnormal pressure detection, could lead to a 5 to 15% improvement in overall drilling rate.

In addition, downhole measurements while drilling may reduce costs for consumables, such as drilling fluids and bits, and may even help avoid setting pipe too early. If in the event MWD allowed elimination of a single string of casing, further savings could be achieved since smaller holes could be drilled to reach the objective horizon. Since the time for drilling a well could be substantially reduced, more wells per year could be drilled with available rigs. The savings described would be free capital for further exploration and development of energy resources.

Still further knowledge of subsurface formations will be improved. Downhole measurements while drilling will allow more accurate selection of zones for coring, and pertinent information on formations will be obtained while the formation is freshly penetrated and least affected by mud filtrate. Furthermore, decisions regarding completing and testing a well can be made sooner and more competently.

There are two principal functions to be performed by a continuous MWD system: (1) downhole measurements, and (2) data transmission.

The subject invention pertains to the data transmission aspect of MWD. In the past, several systems have been at least theorized to provide transmission of downhole data. These prior systems may be descriptively characterized as: (1) mud pressure pulse, (2) insulated conductor, (3) acoustic and (4) electromagnetic waves.

In a mud pressure pulse system the resistance to the flow of mud through a drill string is modulated by means of a valve and control mechanism mounted in a special drill collar sub near the bit.

The communication speed is fast since the pressure pulse travels up the mud column at or near the velocity of sound in the mud, or about 4,000 to 5,000 fps. However, the rate of transmission of measurements is relatively slow due to pulse spreading, modulation rate limitations, and other disruptive limitations such as the requirement of transmitting data in a fairly noisy environment.

Insulated conductors, or hard wire connection from the bit to the surface, is an alternative method for establishing downhole communications. The advantages of wire or cable systems are: (1) capability of a high data rate; (2) power can be sent down hole; and (3) two way communication is possible. This type of system, however, has at least two disadvantages; it requires a wireline installed in or attached to the drill pipe and it requires changes in usual ring operating equipment and procedures.

One hard wire method is to run an electrical connector and cable to mate with sensors in a drill collar sub. The trade off or disadvantage of this arrangement is the need to withdraw the cable, then replace it each time a joint of drill pipe is added to the drill string. In this and similar systems the insulated conductor is prone to failure as a result of the abrasive conditions of the mud system and the wear caused by the rotation of the drill string. Also, cable techniques usually entail awkward handling problems, especially during adding or removing joints of drill pipe.

As previously indicated, transmission of acoustic or seismic signals through a drill pipe, mud column, or the earth offers another possibility for communication. In such systems an acoustic (or seismic) generator would be located near the bit. Power for this generator would have to be supplied downhole. The very low intensity of the signal which can be generated downhole, along with the acoustic noise generated by the drilling system, makes signal detection difficult. Reflective and refractive interference resulting from changing diameters and thread makeup at the tool joints compounds the signal attenuation problem for drill pipe transmission. Moreover, signal-to-noise limitations for each acoustic transmission path are not well defined.

The last major previously known technique comprises the transmission of electromagnetic waves through a drill pipe and the earth. In this connection electromagnetic pulses carrying downhole data are input to a toroid positioned adjacent a drill bit. A primary winding, carrying the data for transmission, is wrapped around the toroid and a secondary is formed by the drill pipe. A receiver is connected to the ground at the surface and the electromagnetic data is picked up and recorded at the surface.

In conventional drillstring toroid designs a problem is encountered in that an outer sheath which must protect the toroid windings must also provide structural integrity for the toroid. Since the toroid is located in the drill collar, large mechanical stresses will be imposed on it. These stresses include tension, compression, torsion and column bend. This structural problem is quite significant when it is realized that: (1) in prior toroid designs the conductive drill collar was attached at both ends to the outer sheath of the toroid, (2) such structure provided a path for a short circuited turn and (3) in order to prevent short circuits a peripheral insulation gap in the drill collar was required notwithstanding the severe environmental loading.

The problems and unachieved desires set forth in the foregoing are not intended to be exhaustive but rather are representative of the severe difficulties in the art of transmitting borehole data. Other problems may also exist but those presented above should be sufficient to demonstrate that room for significant improvement remains in the art of telemetering MWD borehole data.

OBJECTS OF THE INVENTION

It is therefore a general object of the invention to provide a novel apparatus for use in a system to advantageously telemeter large quantities of real time data from a borehole to the surface.

It is a particular object of the invention to provide a toroidal coupled, data transmission system wherein the normal functioning of a conventional drill collar is not disturbed.

It is a related object of the invention to provide a novel toroidal coupled, data transmission system wherein the drill collar is provided with an electrical isolation system to prevent short circuiting the secondary of the data telemetering system.

It is a further object of the invention to provide a novel electrical isolation assembly for a MWD drill collar which is highly rugged and practical for sustained downhole operation while concomitantly providing a toroidal coupled real time data transmission system.

It is another object of the invention to provide a novel electrical isolation structural assembly wherein the structural integrity of the drill collar is substantially maintained while concomitantly providing electrical isolation of a toroidal coupled data telemetering system.

It is a still further object of the invention to provide a novel electrical isolation structural assembly which may be facilely manufactured and installed in a drill collar and readily repaired without requiring an operator to "break out" the drill collar.

BRIEF SUMMARY OF THE INVENTION

A preferred form of the invention which is intended to accomplish at least some of the foregoing objects comprises a point gap assembly operable to be connected through a lateral wall of a drill collar. More specifically the drill collar is fashioned with a lateral aperature which may be circular in cross-section. An electrical insulation member is positioned within the aperature and surrounds and electrically isolates a conductor from the drill collar. In a preferred embodiment, a cylindrical sleeve or electrical insulation coating is applied about the drill collar above and below the location of the conductor through the drill collar wall. One end of a toroid core secondary is connected to the conductor and the other end is connected to the drill collar such that data carrying electro-magnetic waves may be sent from the drill collar through the earth to telemeter downhole data to the surface.

THE DRAWINGS

Other objects and advantages of the present invention will become apparent from the following detailed description of a preferred embodiment thereof taken in conjunction with the accompanying drawings, wherein.

DETAILED DESCRIPTION

Figure 1:
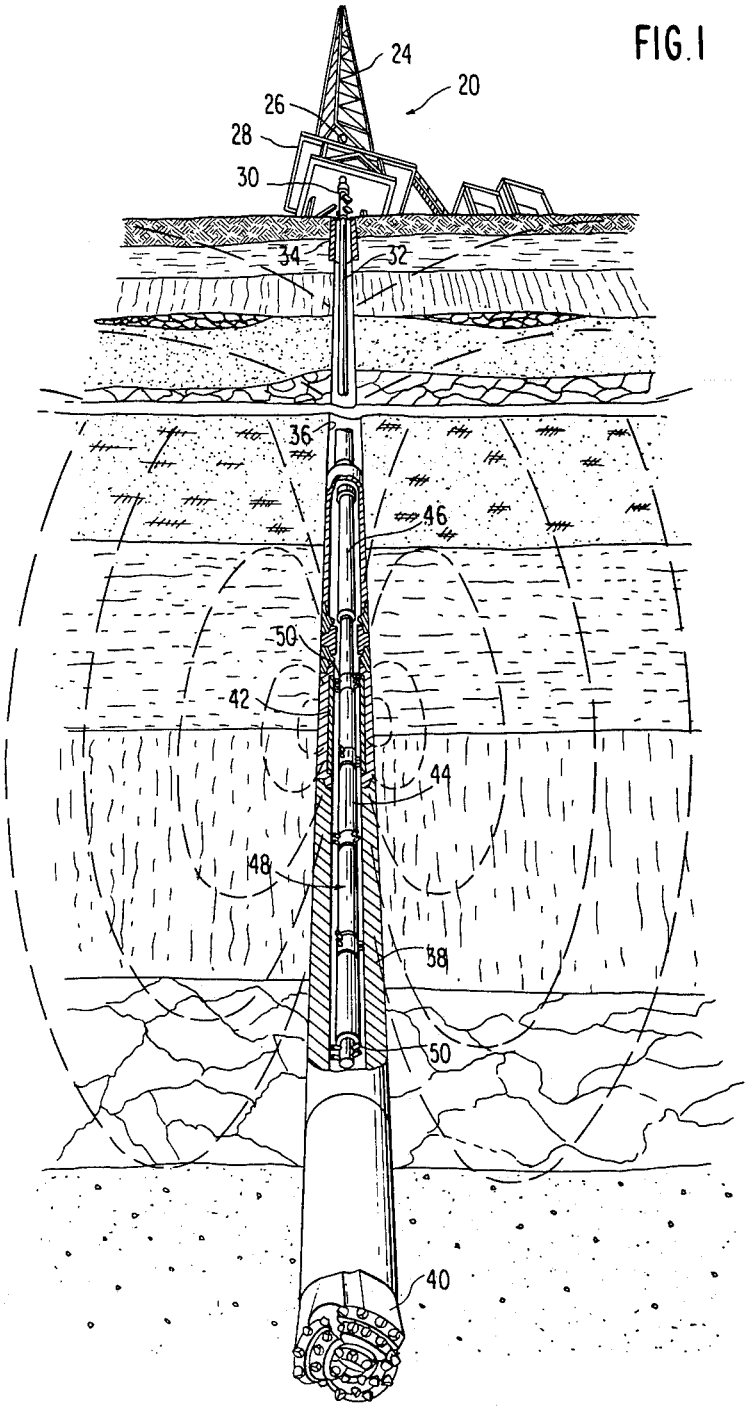
FIG. 1 is a perspective view from the downhole end of a drill string disclosing a drill collar and a toroidal coupled MWD system for continuously telemetering real time data to the surface.

Referring now to the drawings, wherein like numerals indicate like parts, there will be seen various views of a toroidal coupled, telemetry system in which the subject invention has particular application and detail views of a preferred embodiment of the insulated point gap assembly in accordance with the subject invention.

Context of the Invention

Before providing a detailed description of the subject structural assembly, it may be worthwhile to outline the context of the instant invention. In this connection and with reference to FIG. 1 there will be seen a conventional rotary rig 20 operable to drill a borehole through variant earth strata. The rotary rig 20 includes a mast 24 of the type operable to support a traveling block 26 and various hoisting equipment. The mast is supported upon a substructure 28 which straddles annular and ram blowout preventors 30. Drill pipe 32 is lowered from the rig through the surface casing 34 and into borehole 36. The drill pipe 32 extends through the borehole to a drill collar 38 which is fitted at its distal end with a conventional drill bit 40. The drill bit 40 is rotated by the drill string, or a submerged motor, and penetrates through the various earth strata.

The drill collar 38 is designed to provide weight on the drill bit 40 to facilitate penetration. Accordingly such drill collars typically are designed with relatively thick side walls and are subject to severe tension, compression, torsion, column bending, shock and jar loads. In the subject system, the drill collar further serves to enhouse a data transmit toroid 42 comprising a winding core for a downhole data telemetering system. Finally the subject drill collar 38 also functions as a support to hang a concentrically suspended telemetering tool 44 operable to detect and transmit downhole data to the surface concomitantly with normal operation of the drilling equipment.

The telemetering tool 44 is composed of a number of sections in series. More specifically a battery pack 46 is followed by a sensing and data electronics transmission section 48 which is concentrically maintained and electrically isolated from the interior of the drill collar 38 by a plurality of radially extending fingers 50 composed of a resilient dielectric material.

Figure 2:
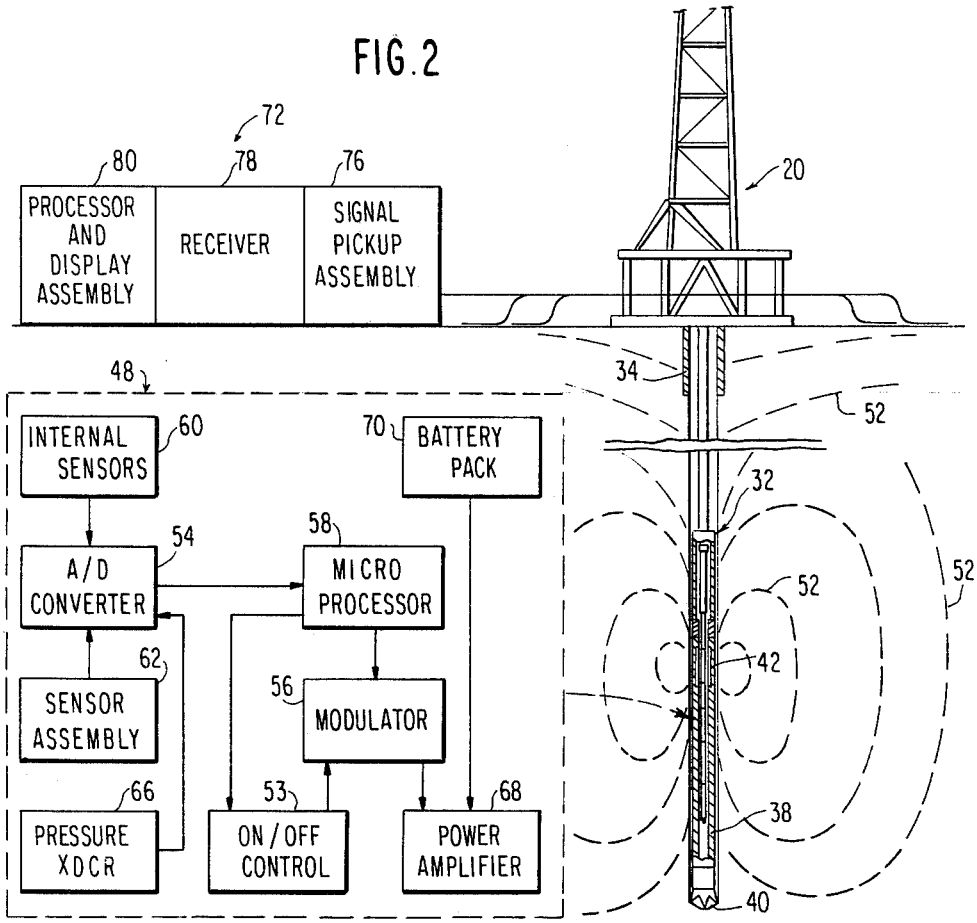
FIG. 2 is a schematic view of the MWD telemetering system disclosed in FIG. 1 including a block diagram of a downhole electronic package, which is structurally internal to the drill collar, and an uphole signal pickup system.
Figure 3:
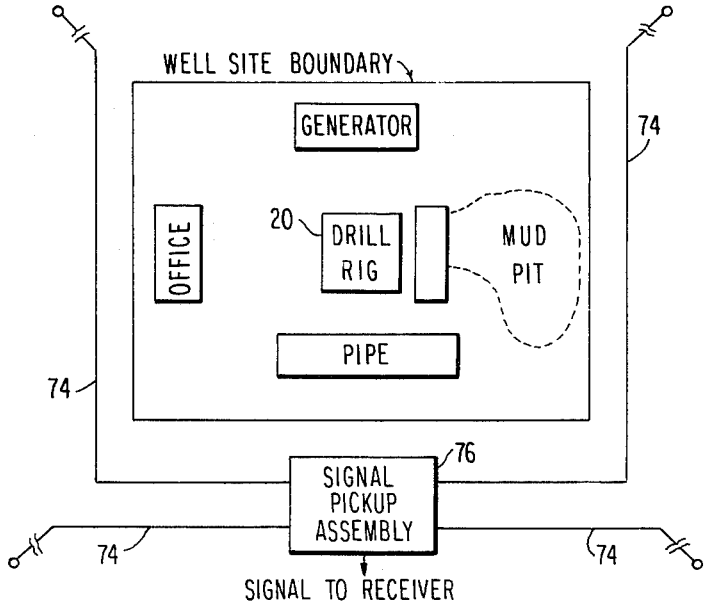
FIG. 3 is a plan view of the uphole system for picking up MWD data signals.

Turning now to FIGS. 2 and 3, there will be seen diagrams for a toroidal-coupled telemetry system. In this system drill bit, environmental and/or formation data is supplied to the tool data electronics section 48. This section includes an on/off control 52, an A/D converter 54, a modulator 56 and a microprocessor 58. A variety of sensors 60, 62 etc. located throughout the drill string supply data to the electronics section 48.

Upon receipt of a pressure pulse command 66, or expiration of a time-out unit, whichever is selected, the electronics unti will power up, obtain the latest data from the sensors, and begin transmitting the data to a power amplifier 68.

The electronics unit and power amplifier are powered from nickel cadmium batteries 70 which are configured to provide proper operating voltage and current.

Operational data from the electronics unit is sent to the power amplifier 68 which establishes the frequency, power and phase output of the data. The data is then shifted into the power amplifier 68. The amplifier output is coupled to the data transmit toroid 42 which electrically approximates a large transformer wherein the drill string 32 is a part of the secondary.

The signals launched from the toroid 42 are in the form of electromagnetic wave fronts 52 traveling through the earth. These waves eventually penetrate the earth's surface and are picked up by an uphole system 72.

The uphole system 72 comprises radially extending receiving arms 74 of electrical conductors. These conductors are laid directly upon the ground surface and may extend for three to four hundred feet away from the drill site. Although the generally radial receiving arms 74 are located around the drilling platform, as seen in FIG. 3, they are not in electrical contact with the platform or drill rig 20.

The radial receiving arms 74 intercept the electromagnetic wave fronts 52 and feed the corresponding signals to a signal pickup assembly 76 which filters and cancels extraneous noise which has been picked up, amplifies the corresponding signals and sends them to a low level receiver 78.

A processor and display system 80 receives the raw data output from the receiver, performs any necessary calculations and error corrections and displays the data in a usable format.

Figure 4:
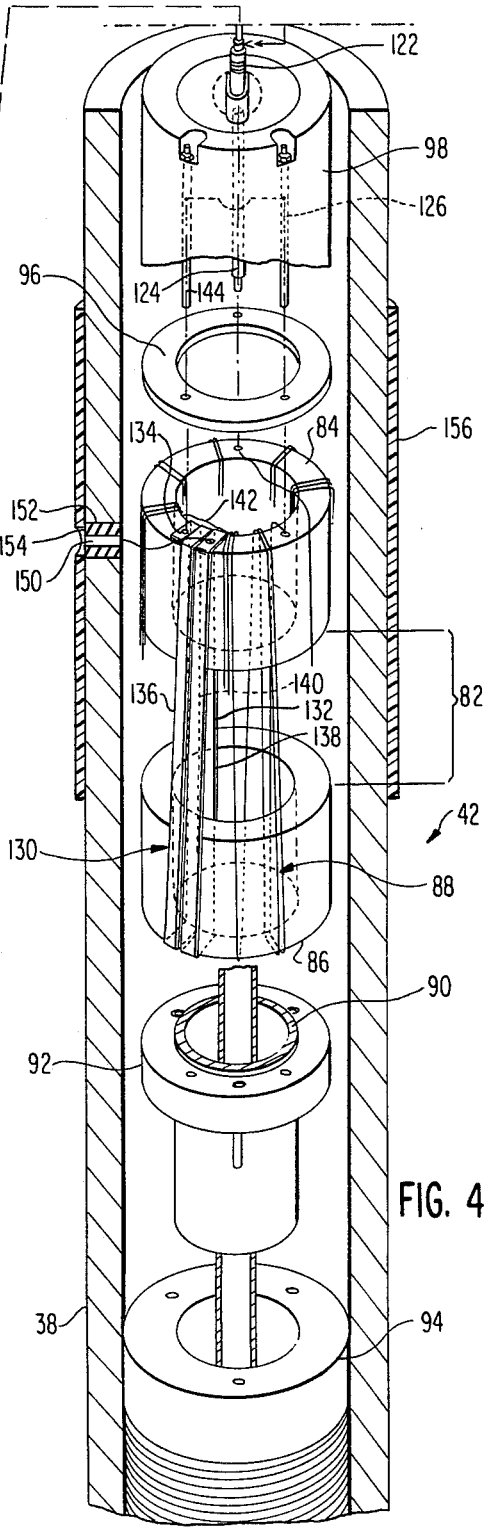
FIG. 4 is an exploded, schematic view of a toroid unit and an insulated point gap assembly in accordance with the subject invention.

Referring now to FIG. 4 there will be seen a broken away, partial schematic view of the previously noted data transmit toroid 42. In this view the toroid is composed of a plurality of cylindrical members (not shown) which are positioned in area 82. The word "toroid and toroidal" are terms of art in the industry and refer to cylindrical structures as opposed to the strictly accurate geometrical definition of a body generated by a circle. An upper termination block 84 and lower termination block 86 illustrates the configuration of the intermediate toroids. The cylindrical toroid cores are composed of a ferromagnetic material such as silicon steel, permalloy, etc. The termination blocks are composed of aluminum with an insulation coating and serve to hold the intermediate toroid cores in position and provide end members to receive a primary toroid winding 88.

The toroid package is mounted about a mandrel 90 which extends up through the toroid collars. In FIG. 4, however, the mandrel is broken away to better illustrate the primary winding 88 of the toroid. The mandrel 90 has a radially extending flange 92 which rests upon and is bolted to a bottom sub 94 connected to the drill collar. A similar support arrangement, not shown is provided above an insulated spacer ring 96 and an electrical connector block assembly 98 to fixedly secure and join the toroid section 42 to the drill collar 38. In substance thereby the toroid becomes a part of the drill collar and drilling mud flows in an uninterrupted path through the center of mandrel 90 to permit a continuous drilling operation. Although, for ease of illustration, the drill collar 38 is depicted in FIG. 4 as broken at line 91, in actual practice the drill collar is integral from top to bottom.

As previously indicated a telemetering tool 44 is designed to be positioned within the drill collar 38 and hangs from the drill collar by a landing connector 110 having radial arms 112 connected to an upper portion of the tool 44.

The battery pack 46 is schematically shown encased within an upper segment of tool 44. A negative of the battery pack is connected to the tool 44 which is in direct electrical communication to the drill collar 38 and drill pipe 32, note the schematic representation at 114. The positive terminal of the battery pack 46 extends along line 116 to a data source schematically depicted at 118. The data to be transmitted to the surface is input to the toroid system at this point.

The line 116 then feeds into an electrical connector guide, schematically shown at 120. The guide may be a spider support arrangement which the tool slides into to establish an electrical couple between line 116 and electrical connector 122. The line then passes through a cylindrical insulation sleeve 124 and connects directly to the primary 88 of the toroid assembly 42. The other end of the toroid primary extends through the electrical block housing 98 at 126 and connects to an outer sheath of the electrical connector 122 which is in communication with the tool outer sheath through line 128 and thus back to ground in the drill collar at 114.

Point Gap Assembly

At least one secondary winding 130 is provided on the toroid cores at area 82 which in a preferred embodiment comprises a conductive strap 132. The conductive strap 132 starts at a mounting point 134 on the upper termination block 84, extends along the interior of the toroid core collars up along the outside of the core collars, note segment 136, down the interior again, note segment 138, and up the outside of the core collars, note segment 140, to terminate at a mounting point 142. The strap 132 thus is wrapped two turns around the toroidal core collars.

The starting point 134 of the secondary strap is electrically connected to a pin 144 which in turn is electrically coupled to the drill collar through the electrical connector block housing 98, outer sheath of the electrical connector 122, line 128 and radial arms 112.

The other end of the secondary strap is electrically connected to a conductor 150. The conductor 150 extends through an electrical insulation member 152 which is mounted within an aperture 154 laterally fashioned through the wall of the drill collar 38.

Figure 5:
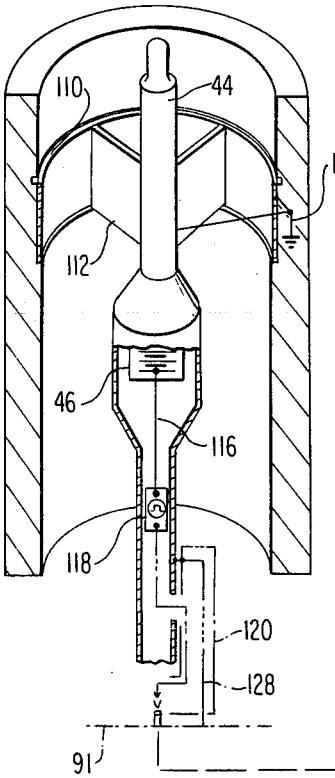
FIG. 5 is a partial side view of the insulated point gap assembly disclosed in FIG. 4.
Figure 5:
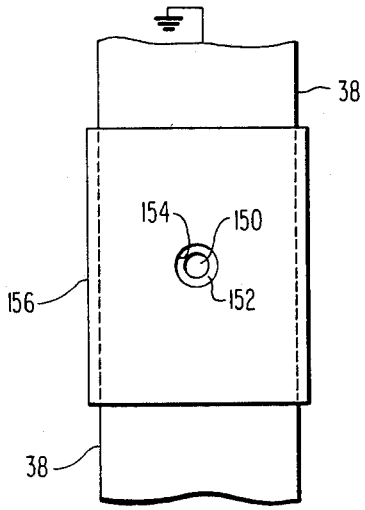

In a preferred embodiment, the aperture 154 is circular in cross-section, note FIG. 5, however, other shapes are contemplated by the invention. The insulation member 152 is composed of a dielectric material which may be relatively thick or comprise a coating of six or more mils in thickness provided the desired electrical isolation of the conductor from the drill collar is achieved. In this connection, electrical isolation is required between the conductor 150 and the drill collar 38 to prevent a short circuit across the secondary.

In a preferred embodiment, a sheath or coating of electrical insulation material 156 is applied to the drill collar at the location of the conductor 150. This sheath minimizes short circuits around the insulation 152 through any well fluid, such as drilling mud, which may surround the drill collar. The axial length of the coating may vary but in a preferred embodiment will extend equal distances above and below the conductor 150.

The drill collar may be recessed to receive the coating and thus present a smooth outer surface for passing drilling fluid. In addition the interfaces of the coating with the drill collar may be further protected by application of a peripheral metallic band or the like.

SUMMARY OF MAJOR ADVANTAGES OF THE INVENTION

After receiving the foregoing description of the preferred embodiments of the invention, in conjunction with the drawings, it will be appreciated by those skilled in the art that several distinct advantages are obtained by the subject invention.

Without attempting to detail all of the desirable features specifically and inherently set forth above, a major advantage of the invention is the provision of an insulated drill collar point gap assembly for a toroidal coupled telemetry system wherein normal functioning of the drill collar is maintained. At the same time transmission of large quantities of real time data to the surface is achieved by electromagnetically coupling a primary toroid winding carrying the data with a secondary which transmits data to the surface through the earth.

The subject insulated point gap assembly permits the foregoing data transmission because of the electrical isolation provided thereby and thus eliminating or minimizing the possibility of providing a secondary short turn within the system.

The subject insulated point gap assembly provides electromagnetic transmission through the earth by isolating the ends of the toroid secondary without weakening the structural integrity of the drill collar.

Further the electrical insulation coating axially extends along the drill collar and further isolates the conductor connected to one end of the secondary from the drill collar connected to the other end of the secondary through any well fluid surrounding the drill collar.

The aperture through the drill collar is easily fashioned as placement of the conductor and insulation may also be facilely achieved. In a similar view, in the event of a breakdown in the insulation, the point gap assembly may be quickly replaced without requiring the drill collar to be broken apart or separated.

In describing the invention, reference has been made to a preferred embodiment. Those skilled in the art, however, and familiar with the disclosure of the subject invention, may recognize additions, deletions, modifications, substitutions and/or other changes which will fall within the purview of the subject invention as defined in the claims.

We claim:

1. An insulated point gap assembly for a toroidal coupled telemetry system for telemetering downhole measurements-while-drilling information from a wellhole to the surface of the earth wherein a drill collar operable to be connected to a lower portion of a drill string carries a toroidal core within the wall of said drill collar having primary windings such that data to be telemetered to the surface may be input to the toroidal core through the primary windings, said insulated point gap assembly comprising:

a generally cylindrical aperture radially extending through the side wall of the drill collar and opening into the drill collar at a position adjacent to the downhole data transmit toroid core;

an electrical insulation member coextensive with said aperture and extending through the side wall of the drill collar and being intimately positioned within and carried by said aperture;

an electrical conductor coaxially extending through said electrical insulation member and through the side wall of the drill collar and being outwardly in direct electrical contact with fluid and earth formations surrounding the drill collar while concomitantly being electrically insulated from said drill collar for providing a conductive path through the side wall of the drill collar so as to permit measurements-while-drilling data to be transmitted from the toroid core through the drill collar and into the earth formation surrounding the drill collar; and at least one secondary conductor wrapped around said toroidal core and one end of said secondary conductor being connected to said conductor coaxially extending through said electrical insulation member and the drill collar side wall while the other end of said at least one secondary conductor being electrically connected to said drill collar such that downhole measurements-while-drilling data may be transmitted from the drill collar and into the surrounding earth formation for electromagnetic transmission through the earth and to the surface of the earth.

2. An insulated point gap assembly for a toroidal coupled telemetry system as defined in claim 1 and further comprising:

an electrical insulation coating coaxially applied around the exterior surface of the drill collar axially at the location of said conductor and having a radial aperture therein axially aligned with said conductor to permit electrical contact of the conductor with drilling fluid surrounding the drill collar while concomitantly providing a degree of axial electrical isolation of the conductor from the immediately surrounding drill collar surface through the drilling fluid.

3. An insulated point gap assembly for a toroidal coupled telemetry system as defined in claim 2 wherein:

said electrical insulation member comprises a dielectric coating about said conductor and the axial extend of said electrical insulation coating above said conductor extending through the wall of the drill collar is equal to the axial extent of said electrical insulation coating below said conductor.

4. An insulated point gap assembly for a toroidal coupled telemetry system as defined in claim 2 or 3 wherein:

said electrical insulation sleeve surrounding the drill collar is recessed within the surface of the drill collar.

* * * * *